United States Patent [19]

Phillips

[11] Patent Number: 4,531,325

[45] Date of Patent: Jul. 30, 1985

[54] HINGED VEHICLE GATE ARM

[76] Inventor: David A. Phillips, 1055 6th Ave., Des Moines, Iowa 50314

[21] Appl. No.: 607,710

[22] Filed: May 7, 1984

[51] Int. Cl.[3] ..... E01F 13/00

[52] U.S. Cl. ..... 49/49

[58] Field of Search ..... 49/49, 35, 141, 9, 192, 49/34

[56] References Cited

U.S. PATENT DOCUMENTS

| | | | |
|---|---|---|---|
| 1,832,645 | 11/1931 | Meyer et al. | 49/192 |
| 1,886,719 | 11/1932 | Oaks et al. | 49/9 X |
| 2,874,493 | 2/1959 | Mandel | 49/9 X |
| 4,364,200 | 12/1982 | Cobb | 49/49 X |

*Primary Examiner*—Philip C. Kannan

*Attorney, Agent, or Firm*—Kent A. Herink; G. Brian Pingel

[57] ABSTRACT

A hinged vehicle gate arm is mounted for automatic traffic control on a gate operating mechanism. The arm includes a first section mounted to the gate operating mechanism and a second section attached to the first section by a hinge assembly for pivotal deflection of the second section upwardly of the first section. A resilient roller is mounted for longitudinal rotation below and substantially the length of the second section. The resilient roller and hinged section section limit damage to a vehicle contacted by the arm lowered by the gate operating device.

8 Claims, 4 Drawing Figures

HINGED VEHICLE GATE ARM

BACKGROUND OF THE INVENTION

The present invention relates to a hinged vehicle gate arm. More particularly, the invention relates to a vehicle gate arm having a protective roller on a hinged section for limiting the damage caused to a vehicle contacted by the lowering arm section.

Automatically operable vehicle gates are used to control ingress to and egress from parking areas, buildings, and the like. Typically, a rigid elongate arm is horizontally extended across a gateway to prevent unauthorized vehicular traffic. Remote sensing and control means for operating an arm lifting mechanism may be activated only for an authorized vehicle. The arm is automatically lowered once the authorized vehicle has cleared the gateway.

It is not uncommon, however, that the gate arm may be lowered onto an intervening vehicle. Such a vehicle may be an unauthorized vehicle that is trying to follow closely an authorized vehicle through the gateway. Alternatively, the automatic gate may malfunction and prematurely lower onto an intervening authorized vehicle. More advanced automatic gates sense the impact of the arm on the vehicle and automatically raise the arm back up again. However, both the impact of the arm on the vehicle as well as the scraping of the arm against the moving vehicle before the motion of the arm is reversed and the arm is raised often cause considerable damage, particularly to the vinyl tops or painted roof surfaces of automobiles.

SUMMARY OF THE INVENTION

In the present invention, an elongate arm is comprised of a first section attached to an automatic vehicle gate operating mechanism, and of a second section adjoining and ordinarily aligned with the first section. A hinge assembly having a pivot axis transverse to the gate arm joins the two arm sections and permits pivotal movement of the second arm section upwardly of the first arm section. A longitudinally extended roller projects below and substantially the length of the second arm section. The roller is covered with a resilient sleeve to prevent damage to a vehicle contacted by the gate arm when lowered by the automatic vehicle gate operating device.

It is therefore an object of the invention to provide a hinged gate arm, operable by a conventional automatic vehicle gate operating mechanism, which protects against damage to an intervening vehicle upon which the arm is lowered.

It is a further object of the invention to provide a hinged gate arm which may be opened manually or fixed in an open position to permit vehicular traffic if the automatic vehicle gate operating mechanism malfunctions or if a power outage occurs.

DETAILED DESCRIPTION OF A PREFERRED EMBODIMENT

Figure 1:
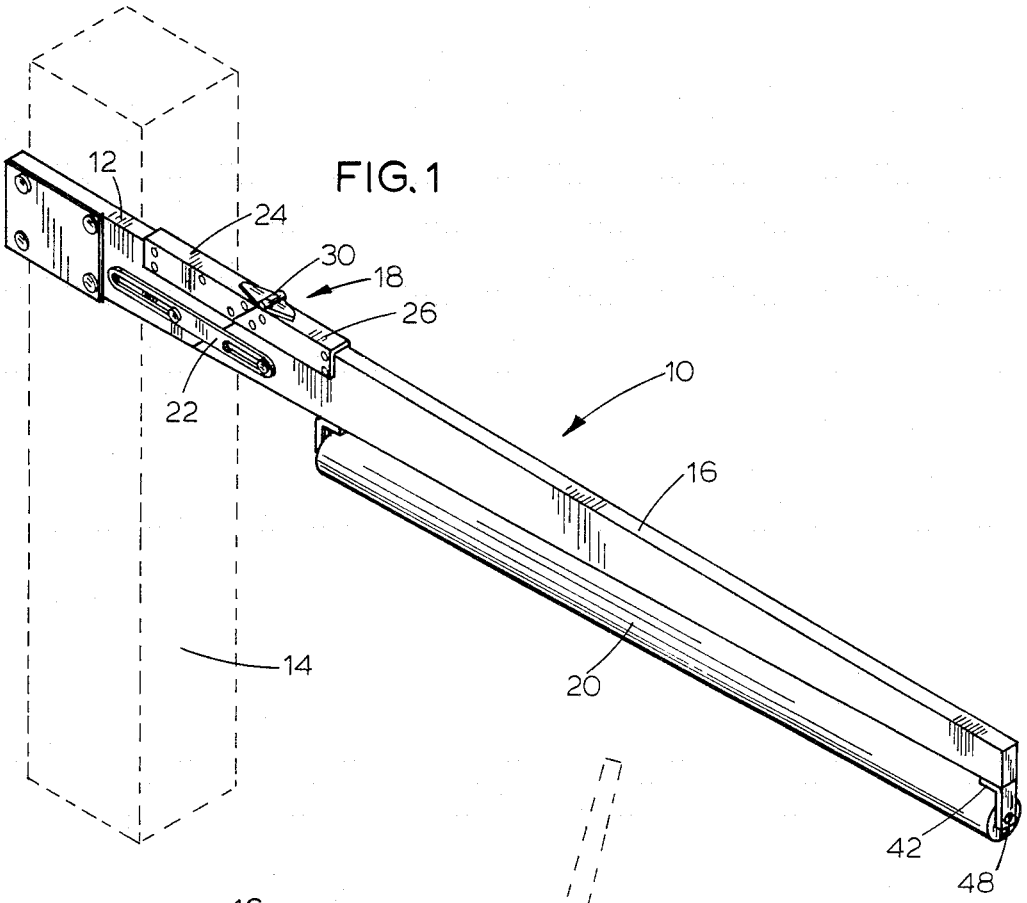
FIG. 1 is a perspective view of the hinged vehicle gate arm mounted on an automatic vehicle gate operating mechanism.

With respect to FIG. 1, a vehicle gate arm, indicated generally at 10, is comprised of a first arm section 12 mounted to an automatic vehicle gate operating mechanism 14, and of a second arm section 16 attached to the first arm section 12 by a hinge assembly 18 and carrying a longitudinally extended roller 20. The arm 10 is shown in its lower or closed position horizontally extended transversely of a gateway (FIG. 4) for vehicles. In the closed position, the arm 10 effectively prevents vehicular traffic through the gateway.

The first and second arm sections 12 and 16, respectively, are ordinarily longitudinally aligned with their adjacent end surfaces in contact engagement with each other. The two sections 12 and 16 are conveniently made from a conventional wooden vehicle gate arm divided along a transverse line, illustrated at 22, which angles upwardly and outwardly from the gate operating mechanism 14. The two sections are pivotally attached to each other by the hinge assembly 18 mounted along the upper portions of the adjacent end portions of the two arm sections 12 and 16.

Figure 3:
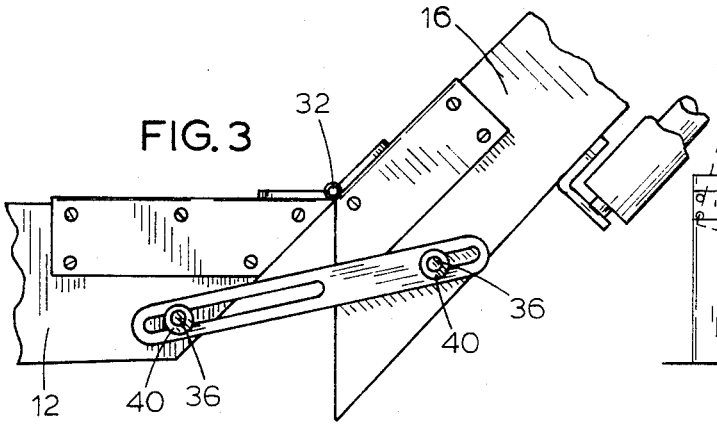
FIG. 3 is an enlarged sectional view of a hinge assembly for pivotal movement of the second arm section upwardly of the first arm section.
Figure 2:
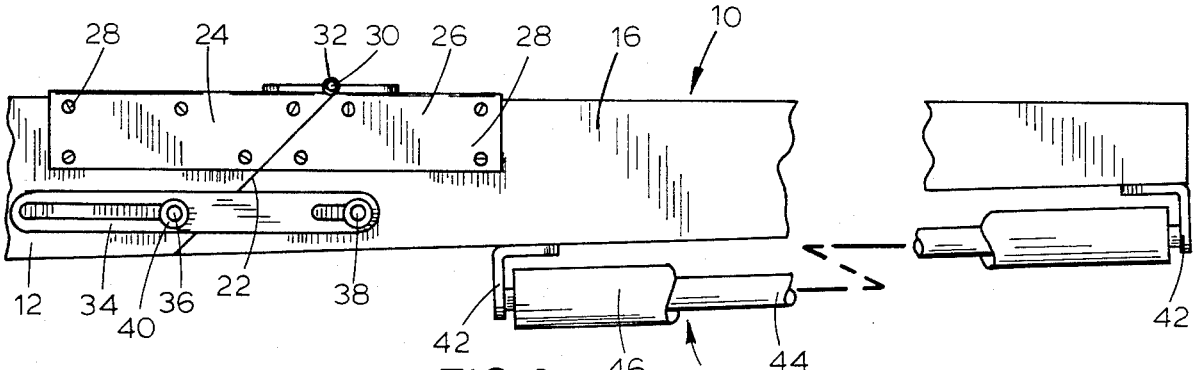
FIG. 2 is an enlarged foreshortened sectional view of the gate arm in its ordinary position with a first section thereof adjoining and longitudinally aligned with a second section thereof.

The hinge assembly 18 in its closed position, with the adjacent end surfaces of the two arm sections 12 and 16 in contact engagement, is illustrated in detail in FIG. 2. Included in the hinge assembly 18 is an upwardly inclined attachment channel 24 and a downwardly inclined attachment channel 26. The two channels 24 and 26 fit closely over the adjacent end portions of the two arm sections 12 and 16, respectively. Each channel is secured to its respective arm section by a plurality of bolts or screws 28 such that the inclined surface of each channel is substantially coincident with the transverse line 22. The inner top portions of the channels 24 and 26 intermesh to form a transverse hinge sleeve 30 (FIGS. 1 and 2) near the junction of the arm sections 12 and 16 at the upper end of the line at 22. A hinge pin 32 is inserted within the hinge sleeve 30 to complete the hinge assembly 18. The second arm section 16 can now pivot upwardly of the first arm section 12 about the axis of the hinge pin 32, as illustrated in FIG. 3.

Lateral strength is added to the hinge assembly 18 and gate arm 10 by a pair of sliding guide members, one of which is illustrated in FIG. 2 at 34. A similar guide member is attached on the other side of the arm 10 and is not shown. A first mounting bolt 36 extends transversely through the first arm section 12 below the channel 24. A second mounting bolt 38 extends transversely through the second arm section 16 below the channel 26 and in substantially horizontal alignment with the first mounting bolt 36. A bushing (not shown) is placed over each mounting bolt to provide a sliding surface for the guide members 34. Then, the outer ends of the bolts 36 and 38 are received in the channel of the guide members 34 and secured by washers and nuts 40. The guide members 34 act to restrict the pivotal motion of the second arm section 16 to the vertical plane defined by the motion of arm 10 as operated by the gate operating mechanism 14. The closed ends of the guide members 34 act as stops on the angular deflection of the second arm section 16, and should therefore be of a length to permit approximately a 90° angle between the two arm sections. Further, the washers and nuts 40 can be tightened to fix the second arm section 16 in an upper position so as to temporarily open the gateway in the event of a power failure or malfunction of the gate operating mechanism 14.

Alternatively, the bolts 36 and 38 may be used to adjust the maximum upward deflection of the second arm section 16. If the outer or second bolt 38 is tightened at the inner end of the outer slot, as shown in FIG. 3, the second arm section 16 may be deflected upwardly through the range of motion defined by the sliding of bolt 36 in the inner slot. However, tightening the first bolt 36 at the outer end of the inner slot will limit the range of upward deflection of the second arm section 16 to the smaller distance defined by the sliding of bolt 38 in the outer slot.

As best illustrated in FIGS. 1 and 2, the roller 20 is mounted for rotation longitudinally below the second arm section 16 by a pair of angle members 42. The roller 20 has a central shaft 44, which may be conveniently constructed of hardwood, and which is covered by a closely fitted resilient sleeve 46. Each end of the shaft 44 is rotatably mounted at 48 in a depending leg of the angle brackets 42. The roller 20 extends substantially the entire length of the second arm section 16 and has a transverse diameter which preferably exceeds the transverse thickness of the second arm section 16.

Figure 4:
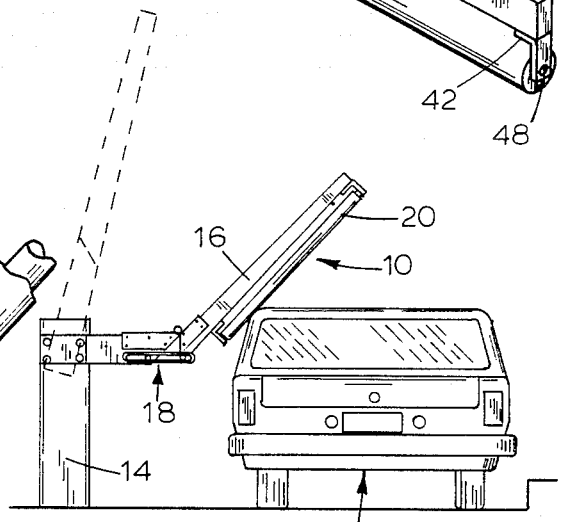
FIG. 4 is a side view of the arm showing in broken line the open position thereof, and showing in solid line the arm in contact with a vehicle in the gateway wherein the second arm section has pivoted upwardly of the first arm section.

Sensing means (not shown) of a control unit of the automatic vehicle gate operating device 14 are activated by only an authorized vehicle. The gate operating device 14 upwardly pivots the first arm section 12, which raises the arm 10 to the open position indicated by broken line in FIG. 4, to permit passage of a vehicle, such as that illustrated in FIG. 4 at 50, through the gateway. During ordinary operation, the sensing means would cause the gate operating device 14 to lower the arm 10 after the vehicle has passed through the gateway beyond the lower position (FIG. 1) of the arm 10. If, however, the arm 10 is, either intentionally or unintentionally, lowered when the vehicle 50 is still below the second arm section 16, the roller 20 will contact the vehicle 50 and the second arm section 16 will pivot upwardly about the hinge assembly 18 (FIG. 4). The resilient sleeve 46, cushions the intial impact of the roller 20 against the vehicle 50. Moreover, the roller 20 rotates while the resilient sleeve 46 is in contact with the vehicle 50 so that no part of the arm 10 slides against the vehicle 50. Thus, contact of the arm 10 on the vehicle 50 will not damage either the arm or the vehicle. The hinged gate arm 10 can ordinarily permit vehicles contacted by the arm 10 to continue forwardly through the gateway without damage. A driver of the vehicle can, alternatively, back from under the arm 10 and reenter the gateway after triggering the sensing means.

Although the invention has been described with respect to a preferred embodiment thereof, it is to be understood that it is not to be so limited since changes and modifications can be made therein which are within the full intended scope of this invention as defined in the following claims.

I claim:

1. A vehicle gate arm for attachment to an automatic vehicle gate operating mechanism for raising and lowering the vehicle gate arm to regulate vehicular traffic, the vehicle gate arm comprising:

(a) an elongate arm attached to the gate operating mechanism; and (b) a padded roller mounted for rotation longitudinally below said elongate arm for preventing damage to a vehicle beneath said elongate arm lowered by the gate operating mechanism.

2. A hinged vehicle gate arm for attachment to an automatic vehicle gate operating mechanism for raising and lowering the vehicle gate arm to regulate vehicular traffic, the vehicle gate arm comprising:

(a) an elongate arm including a first arm section attached to the gate operating mechanism and an adjoining second arm section;

(b) a roller mounted for rotation longitudinally below the second arm section; and (c) hinge means connecting the first arm section to the second arm section for pivotal movement of the second arm section upwardly from the first arm section in response to contact of said roller with a vehicle beneath the second arm section lowered by the gate operating mechanism.

3. The vehicle gate arm of claim 2, wherein:

(a) said elongate arm is a conventional wooden parking gate arm divided into said first section and said second section.

4. The vehicle gate arm defined in claim 2, wherein:

(a) said hinge means include guide means between said first arm section and said arm section for restraining pivotal movement of the second arm section upwardly of the first arm section to a substantially vertical plane defined by the vehicle gate arm raised by the gate operating mechanism.

5. The vehicle gate arm of claim 4 wherein:

(a) said guide means are a pair of slide channels on either side of said elongate arm and slidably attached by bolt assemblies between said first arm section and said second arm section.

6. The vehicle gate arm of claim 4, wherein:

(a) said guide means are adjustable to fix said second arm section pivoted upwardly of said first arm section to permit unregulated vehicle traffic.

7. A hinged vehicle gate arm attached to an automatic gate operating mechanism for raising and lowering the vehicle gate arm to regulate vehicular traffic, said vehicle gate arm comprising:

(a) an extended arm including an inner first arm section mounted to the gate operating mechanism and an outer arm section;

(b) hinge means connecting the two arm sections for relative pivotal movement of the outer arm section upwardly from the inner arm section; and (c) a padded roller rotatably mounted for longitudinal rotation below the outer arm section for preventing damage to a vehicle beneath said outer arm section lowered by the gate operating mechanism.

8. A hinged vehicle gate arm for attachment to an automatic vehicle gate operating mechanism for raising and lowering the vehicle gate arm to regulate passage of vehicles through a gateway, said vehicle gate arm comprising:

(a) an elongate arm divided into an inner arm section mounted to the gate operating mechanism and an outer arm section extended outwardly of said inner arm section;

(b) a hinge assembly secured to adjacent end portions of said arm sections for pivotal movement of said outer arm section upwardly from said inner arm section;

(c) guide channels slidably attached between said arm sections for limiting the pivotal movement of said outer arm section substantially to a plane defined by the vehicle gate arm raised by the gate operating mechanism, wherein said guide channels may be secured to said arm sections to fix said outer arm section pivoted upwardly of said inner arm section to permit unregulated passage of vehicles through the gateway; and (d) a roller mounted for longitudinal rotation below and extended substantially the length of said outer arm section, said roller having an outer resilient sleeve to limit damage to a vehicle within the gateway contacted by said roller.

* * * * *